United States Patent [19]

Ek et al.

[11] 4,252,251

[45] Feb. 24, 1981

[54] SHEET-DISPENSING APPARATUS

[75] Inventors: Jan-Olof Ek, Alvsjo; Leif Lundblad, Huddinge, both of Sweden

[73] Assignee: Inter Innovation AB, Stockholm, Sweden

[21] Appl. No.: 85,122

[22] Filed: Oct. 12, 1979

Related U.S. Application Data

[63] Continuation-in-part of Ser. No. 916,808, Jun. 19, 1978, abandoned.

[51] Int. Cl.[3] ..... B65H 1/14

[52] U.S. Cl. ..... 221/227; 271/154

[58] Field of Search ..... 221/226, 227, 259; 271/147, 152, 153, 154, 155, 126

[56] References Cited

U.S. PATENT DOCUMENTS

| | | | |
|---|---|---|---|
| 3,123,355 | 3/1964 | Lessig | 271/154 |
| 4,113,140 | 9/1978 | Graef et al. | 221/227 X |

*Primary Examiner*—Stanley H. Tollberg

*Attorney, Agent, or Firm*—Kinzer, Plyer, Dorn & McEachran

[57] ABSTRACT

A device for feeding bank notes, receipts, tickets or similar items from a bundle of such items. This device includes a wheel, roller or belt arranged at one end of the bundle for dispensing, during operation, the outer most bank note ticket or like item from the bundle. The machine is characterized by a lifting mechanism arranged to lift the bundle towards the wheel, roller or similar device, depending on the distance between sequentially dispensed bank notes, tickets or similar items.

4 Claims, 4 Drawing Figures

SHEET-DISPENSING APPARATUS

This is a continuation-in-part application of Ser. No. 916,808 filed June 19, 1978 now abandoned.

BACKGROUND OF THE INVENTION

1. Field of the Invention

The present invention relates to an apparatus for dispensing sheet-like objects, such as tickets, banknotes and like sheets from a bundle thereof, and more specifically, although not exclusively, to such an apparatus which comprises a wheel, roller, belt or like element arranged at one end of said bundle and adapted, during a dispensing operation, to remove successively the sheets from the top of said bundle one at a time and dispensing said sheets to a receiving station.

Examples of the fields in which the invention can be used include cash-registering machines, banknote-dispensing machines and like apparatus in which the correct number of banknotes, receipts or the like shall be dispensed at all times irrespective of their condition, i.e. irrespective of whether the tickets, banknotes or the like are new or old, whole or worn, thin or thick etc.

Such sheet-dispensing apparatus are known to the art. One such apparatus is described in U.S. Pat. No. 3,123,355. This apparatus comprises a sheet stack support and associated members for advancing the stack of sheets to a sheet separation station, at which the sheets are separated individually by a sheet picking device and forwarded to their destination. Means are provided for gauging or sensing the level of the sheet stack, as sheets are separated therefrom by the feeding device, for actuating a drive motor in a jogging motion for driving the stack advancing means to present successive end sheets of the stack substantially at the feeding level.

One problem with this and other known apparatus is that they are not totally reliable in function and are not precise enough to be able to dispense sheets at a satisfactory speed when said sheets exhibit in perfections, such as creases, folds, buckles etc.

SUMMARY OF THE INVENTION

An object of the invention is to provide a novel sheet-dispensing apparatus, such as a banknote dispensing apparatus, which will dispense an ordered number of sheets rapidly and reliably and irrespective of the condition of said sheets.

A further object is to provide a sheet dispensing apparatus which will ensure that only the ordered number of sheets is dispensed, i.e. that the number of sheets dispensed corresponds exactly to the number of sheets ordered.

These and other objects and advantages may be obtained by the novel sheet dispensing-apparatus constructed in accordance with the invention and comprising a sheet support means arranged for movement between a first terminal position and a second terminal position;

(b) a sheet picking and dispensing device arranged at said second terminal position;

(c) first drive means coacting with said sheet-supporting means in a manner to move said means between said terminal positions and between positions intermediate thereof;

(d) second drive means operative to drive said sheet picking and dispensing device in a manner to dispense a given number of sheets from a bundle of such sheets carried by said sheet-supporting means;

(e) sheet-ordering means through which a required number of sheets to be dispensed can be ordered;

(f) control circuit means arranged to cooperate with said first and said second driving means in a manner to energize and de-energize the same upon receipt of an appropriate signal;

(g) sheet-detecting means arranged to detect the dispensement of a sheet;

said control circuit means comprising:

a counter for storing the number of sheets ordered; means for energizing said first and said second drive means upon activation of said sheet ordering means such that said sheet-supporting means is moved towards said second terminal position for dispensing a sheet; means for de-energizing (30 ms) said first drive means over a given first time period upon receipt of a sheet-detection signal from said detecting means, informing that a sheet has been dispensed; means for reenergizing said first drive means for a second time period of 10 ms when said first time period has lapsed, such as to move said sheet-support means towards said second terminal position; means for adjusting said first given time period when the time lapse between two consecutively issued sheet-detection signals is shorter than a third given time period; and means for re-energizing said first drive means to advance said sheet-supporting means towards the second terminal position in the absence of a sheet-detection signal within a fourth given period of time.

In order to prevent the number of sheets dispensed exceeding the ordered number, means are conveniently provided for moving said sheet-supporting means away from said second terminal position when the ordered number of sheets has been dispensed.

As previously mentioned, the dispensing apparatus is of the kind which incorporates a driven feed-belt, feed-roller or like feed device, against which a bundle of sheet-like elements, such as banknotes, is brought to bear, the friction between said belt or roller being of a magnitude such as to cause the uppermost sheet in the bundle to be dispensed by means of said belt or roller. It will be understood that if the pressure exerted by the bundle of sheets against said belt or roller is excessive, or that a sheet has become wrinkled or buckled within the bundle in a manner such as to cause the pressure exerted by the bundle against said belt or said roller to increase, the dispenser may attempt to dispense more than one sheet at a time. To prevent this, the sheet dispensing apparatus is conveniently provided with pressure-sensing means which senses the pressure exerted by the bundle of sheets against the belt or the roller and which, when sensing a pressure in excess of a given pressure, causes the bundle of sheets to be lowered somewhat, so as to relieve said pressure. This lowering of the said bundle can be repeated until the sensed pressure is equal to or lower than said given pressure.

In accordance with one embodiment of a sheet-dispensing apparatus according to the invention, the sheet-supporting means is arranged in a cassette intended to receive a bundle of sheets, such as banknotes, tickets, receipts or the like. The sheet-supporting means is activated by means of lifting elements in a manner such that said sheet-supporting means is initially only lifted some few millimeters subsequent to mounting the cassette to the sheet-dispensing apparatus, whereupon movement of said sheet-supporting means is stopped and is not again moved until instructions are received to dispense a given number of sheets.

An exemplary embodiment of the invention will now be described with reference to the accompanying drawings and with reference to a mode of operation which is, today, the best mode known.

Figure 1:
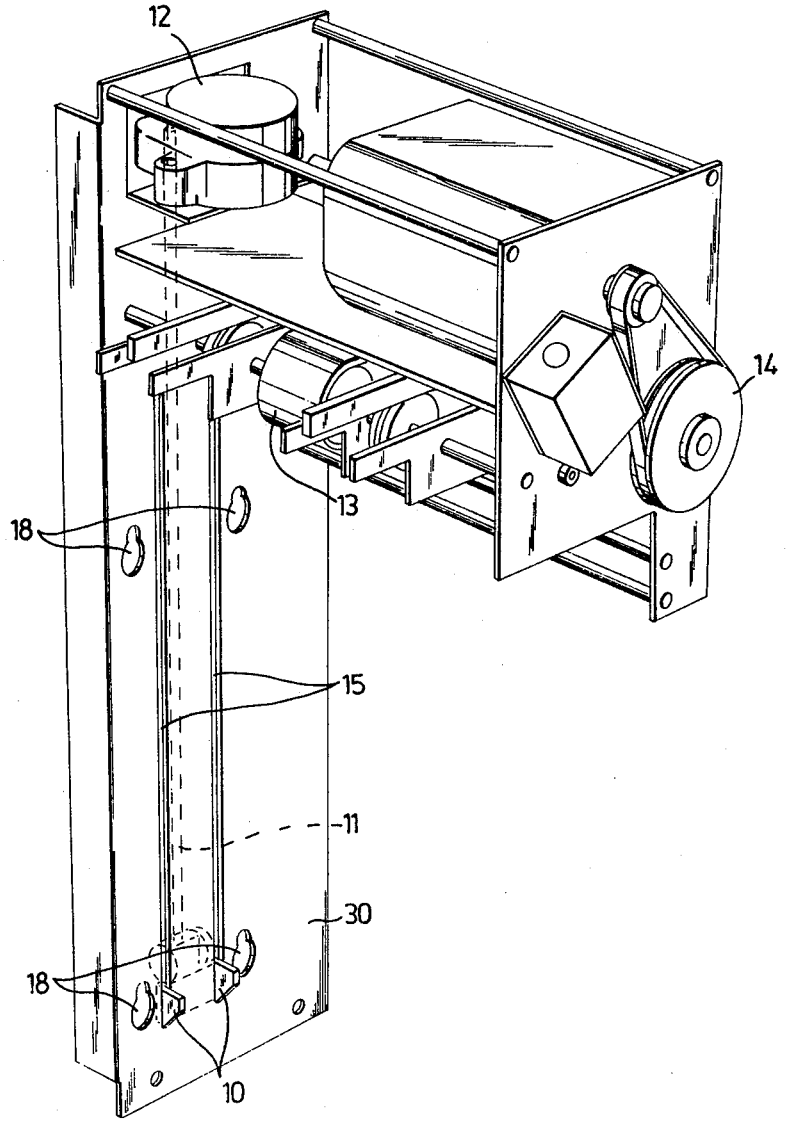
FIG. 1 illustrates part of a dispensing apparatus having lifting means for lifting a bundle of sheets from a first terminal position to a second terminal position, and a belt for feeding the uppermost banknote of said bundle to a receiving station.

The dispensing device illustrated in FIG. 1 comprises a lifting means, incorporating two lifting elements 10 which extend through a plate 41. The lifting means also includes a spindle means 11 which extends along said plate 41 and which is in driving connection with said elements 10 through a nut 11'; and a first drive means in the form of a motor 12 operative to drive said spindle 11. The dispensing apparatus further comprises a belt 13 and a second drive means 14, forming part of a sheet picking and dispensing device driven by a motor 40.

When the motor 12 is activated, the spindle 11 will rotate, thereby to cause the elements 10 to be lifted, said elements 10 being freely movable through two slots 15 extending vertically in said plate 41. When the spindle 11 is rotated in one direction, the elements 10 will be moved upwards towards the belt 13, while when the spindle 11 is rotated in the opposite direction the elements 10 will be moved downwardly away from the belt 13.

Figure 2:
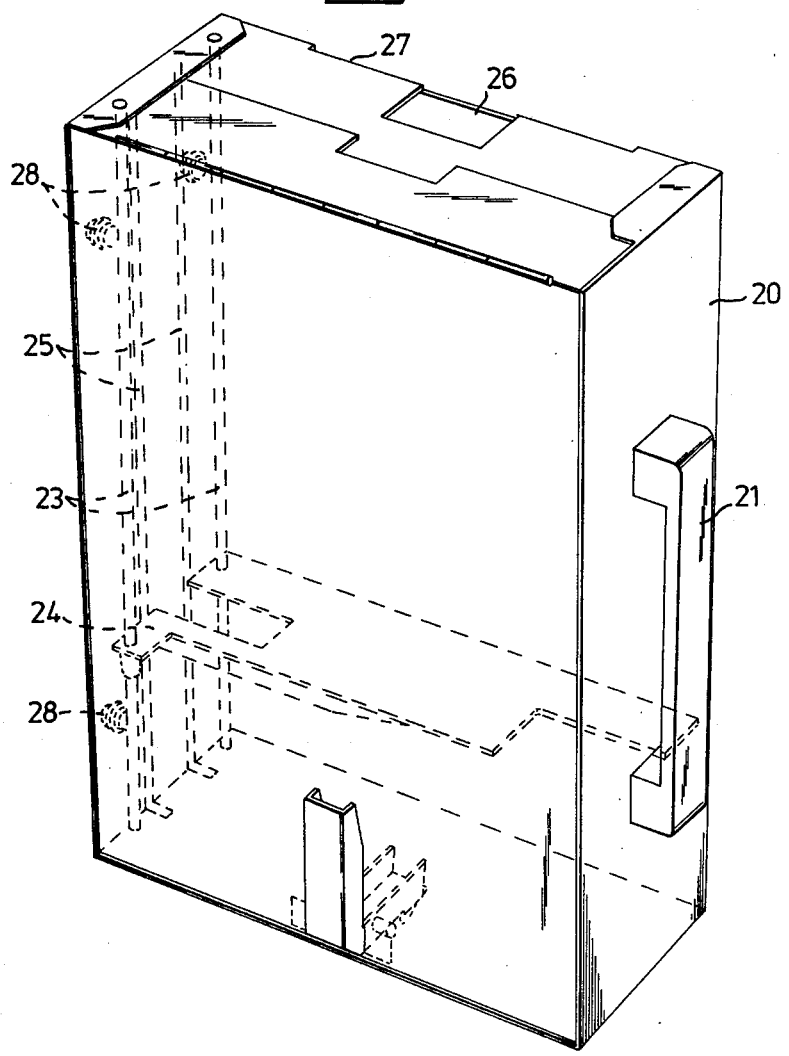
FIG. 2 illustrates a cassette having a sheet-supporting means coacting with said lifting means of the FIG. 1 embodiment for moving said bundle of banknotes towards said second terminal position and FIG. 3 is a block schematic drawing illustrating a control circuit means for carrying out a dispensing operation in accordance with an appropriate one of a number of programmed dispensing sequencies.

A cassette illustrated in FIG. 2 comprises a rectangular casing 20 having a handle 21. Disposed in one of the side surfaces of the casing are two slots 25 which correspond to the slots 15 in FIG. 1. Adjacent the aforementioned side surface of the casing are two vertical rods 23 which are arranged for limited vertical movement and which together carry a bottom plate 24 forming a sheet-supporting means intended to support a bundle of banknotes thereupon and arranged for movement along the rods 23. Arranged in the lid of the cassette is an opening 26 which is in register with the belt 13 in FIG. 1 and which has a longitudinally extending edge opening 27 adapted to permit the passage of a banknote therethrough. Arranged on the outer side of the aforementioned side surface of said casing are four lug-means, of which three are shown in the drawing at reference 28. These lugs are intended to be received in openings 18 illustrated in FIG. 1.

The cassette shown in FIG. 2 is mounted to the device shown in FIG. 1 by the lug means 28, which are received in respective holes 18, the lifting elements 10 projecting through the slots 25. When the motor 12 is started and the spindle 11 rotates, the elements 10 are lifted into abutment with the undersurface of the plate 24; this abutment is detected by the apparatus in a manner hereinafter described. Upon subsequent rotation of the motor 12, the plate 24 together with the bundle of banknotes resting thereupon, will be lifted towards the belt 13, to bring the uppermost banknote into contact therewith. Preferably, the pressure exerted by the banknotes against the belt 13 is sensed by a pressure-sensing device, as hereinafter described.

The mode of operation of the dispensing apparatus illustrated in FIGS. 1 and 2 will now be briefly described.

The lifting means 10-11-12 is arranged to lift the bundle of banknotes together with the plate 24, between a first terminal position, in which the lifting elements 10 first come into abutment with the plate 24, and a second terminal position in which the uppermost banknote of said bundle is in a position to be dispensed by the belt 13. The bundle of banknotes is lifted towards the second terminal position in dependence upon a measured time sequence of dispensed banknotes, as hereinafter described. For example, the dispensing apparatus may be programmed in a manner such that with optimal dispensement of banknotes, the distance in time between two consecutively dispensed banknotes shall be approximately 50 ms. Thus, the apparatus may be programmed such that upon detecting the dispensement of a first banknote, the motor 12 shall be de-activated for a delay period of 30 ms, whereafter the motor 12 is re-activated over a period of approximately 10 ms in order to dispense a further banknote, which will normally take a further period of about 10 ms to be detected, thereby creating a time schedule in total of 50 ms. If no further detection signal is received by a control circuit means after a given period of time, for example after 70 ms, the motor 12 is energized to lift the bundle of banknotes through a further time period of 10 ms, this sequence being possibly repeated several times or until it becomes obvious that a fault has occurred, in which latter case an "out-of-order" signal is generated. On the other hand, should a dispensing signal be transmitted by the banknote detecting means before the time period of 30 ms has lapsed from the recording of a previous detection signal, the program of the control circuit means is such as to ensure that the bundle of banknotes remains stationary over a compensatory period of time, thereby avoid extensive pressure against the belt and to ensure on average that the aforementioned time schedule of 30 ms between consecutively dispensed banknotes is met.

It can be said that when the distance between two sequential banknotes or two consecutive detection signals exceeds a predetermined first value say 30 ms, the lifting means is activated to raise the bundle of banknotes over one time period, and when the distance between two sequential banknotes or two consecutive detection signals exceeds a predetermined second value say 70 ms, the lifting means is again activated to lift the bundle of notes over a further time period; if for some reason—e.g. the bundle of banknotes contains banknotes which are not readily dispensed in a normal manner owing to the fact that said notes are creased, badly worn or have some other impeding defect, no banknote is dispensed within a maximum time period say 2 ms, an out-of-operation signal is generated.

The electronic control arrangement is conveniently formed in a manner such that when the cassette 20 is inserted in the said apparatus, the lifting means 10 is automatically moved into abutment with the plate 24 and the bundle of banknotes lying thereupon to lift said plate slightly, whereupon said movement of said plate is stopped and is not restarted until the sheet-ordering device is activated.

By incorporating a counter for counting the number of banknotes dispensed, the control circuit means can be readily formed in a manner such as to stop the movement of the lifting means subsequent to the instructed number of banknotes being dispensed, until the device is instructed to dispense a further number of notes.

Subsequent to dispensing the ordered number of banknotes, it may be suitable to cause the lifting means 10, and therewith the remaining banknotes resting thereon, to be lowered slightly, so as to release the pressure on the belt 13, thereby avoiding the possibility of exceeding the ordered number of banknotes.

The arrangement may also be such that the bundle of banknotes is also lowered during the dispensing of an instructed number of banknotes. As will be understood, when the distance between two consecutive banknote-detecting signals is shorter than the forementioned time schedule of say 30 ms the motor 12 will not be energized to lift the said bundle until a period commensurate with the shorter period plus the standard delay time has lapsed. It may be expedient however, in this case, to lower the bundle of banknotes in order to ensure that the dispensement of one banknote will not cause the next banknote in line to be entrained therewith. Another situation, however, is one in which (e.g. as a result of a buckled banknote) an excessive pressure has built up between the banknotes comprising said bundle and the discharge belt. This build-up of pressure may also cause malfunctioning of the machine, due to a tendency of the machine to attempt to dispense more than one banknote at a time. To this end the control circuit means 43 is arranged to co-operate with a pressure-sensing means arranged adjacent the openings 26, 27. When the pressure exceeds a given limit pressure, the control circuit means will receive a signal instructing said means to lower the lifting means 10, and therewith the bundle of banknotes. If the pressure then sensed still exceeds said given limit pressure, the control circuit means will receive another signal, instructing it to lower said lifting means still further. This sequence is repeated until the pressure sensed is equal to or below said given limit pressure.

As will be understood, the time sequence with relation to the lifting of the banknotes with each separate dispensing operation may be calculated with the aid of a specific number of revolutions carried out by the spindle. This requires means for detecting movement of the lifting means (i.e. the number of revolutions turned by the spindle), this alternative providing a positive and controllable indication of the relative height to which the lifting mechanism is lifted relative to said number of turns.

It is also conceivable to incorporate a braking means whereby excessive movement of the lifting means is avoided when the motor 12 is stopped.

A detail description of a control circuit means 43 incorporated in the dispensing apparatus according to the invention will now be given with reference to FIGS. 3 and 4.

Figure 3:
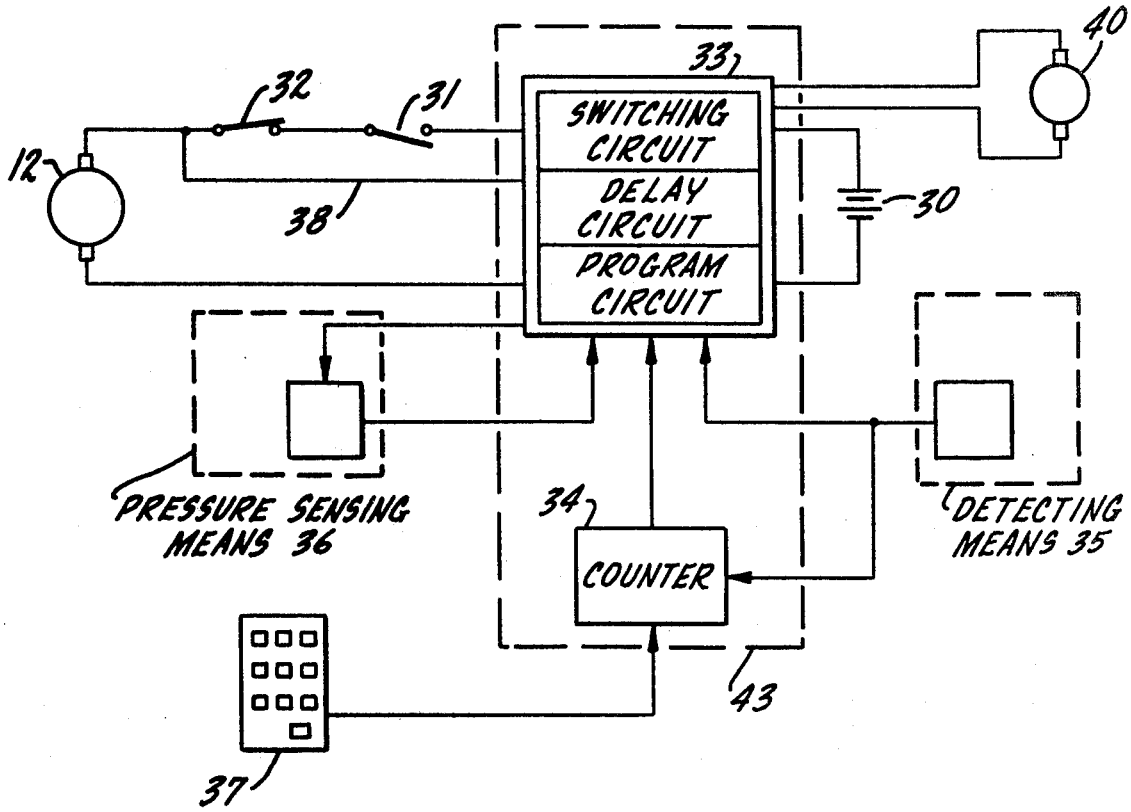

In FIG. 3 it will be seen that the motor 12 for raising and lowering the plate 24 is driven by a source 30 of direct current and energized and de-energized in accordance with a predetermined program incorporated in an automatic control means 33 forming part of said control circuit means 43. Instructions to dispense a number of banknotes are given via a set of buttons 37. The dispensing sequence is influenced by a counter 34 and the control means 33 which receives control signals from both the counter 34 and a banknote detecting means 35, which may be arranged to sense the trailing edge or the leading edge of a banknote, and bundle pressure-sensing means 36. The means 35 for detecting the dispensement of a banknote may comprise a conventional photoelectric sensor and a co-operating light source.

When the cassette illustrated in FIG. 2 is mounted on the dispensing device illustrated in FIG. 1 as described, a switch 31 electrically arranged between the motor 12 and the direct-current source 30 is closed automatically to energize motor 12, or by actuating a button on the button-bank 37, whereupon the lifting elements 10 are raised into abutment with the plate 24. Subsequent to the plate 24 being raised some few millimeters, one or both of the movable rods 23 is or are moved together with said plate, as a result of friction therebetween, a switch 32 electrically arranged in the circuit between the motor 12 and the source 30, being opened so as to de-energize the motor 12 and stop movement of said plate. The switch 32 can be a microswitch or a switch activatable by means of a photo-cell arrangement whose active light beam passes through a hole in one of the rods 23 in its non-raised position. The apparatus is now ready for dispensing an ordered number of banknotes.

Subsequent to setting the required number of banknotes (e.g. 10) into the key-bank 37, this number is sent from the keybank 37 to and is stored in the counter 34 which generates a start signal to the control means 33, thereby activating program circuit and energizing motor 40. Since this is the first dispensing operation to be carried out since the cassette was mounted on the dispensing apparatus, the program circuit of the control means is programmed to operate in accordance with a first, particular program. In accordance with this program, the motor 12 is energized through an electrical conductor 38 and a switching circuit in the control means 33, in a manner such as to cause the spindle 11, and therewith the plate 24, to be continuously lifted until a banknote-detecting signal is received by the control circuit means 33 from the detecting means 35, informing that a banknote has been dispensed. The program circuit then orders the switching circuit to break the current to the motor 12 and lifting of the plate ceases. The aforementioned banknote-detecting signal is produced, for example, by arranging for the leading edge of a dispensed banknote to break the beam of a photo-cell arrangement at a given location in the outfeed path of said banknote.

The banknote-detecting signal from the detecting means 35 is also fed to the counter 34, which forms part of the control circuit means 43 or which may be a separate interger therefrom, and which stores said signal and transmits a further signal to the control means 33. This further signal activates a delay circuit in the control means 33, delaying the re-energization of the motor 12 for a given period of time, e.g. 30 ms. In the normal train of events, nothing will happen until said period has lapsed, one exception being that another banknote is dispensed before the lapse of a given timeperiod, i.e. before the lapse of said desired 30 ms cycle. After this delay period, the motor 12 is re-energized by electronic means in said program circuit incorporated in the said control means 33, which program circuit means causes the current source 30 to be re-connected to the drive means 12, and remains re-energized for a period of roughly 10 ms. The time taken to dispense a banknote when the motor 12 is re-energized is about 10 ms, and as the banknote is dispensed a signal is sent from the detecting means 35 to the automatic control circuit, i.e. to the control means 33 and the counter 34, causing a delay of said given time to be initiated. In this way, the dispenser will normally continue to dispense banknotes within the aforementioned time schedule between consecutive banknotes, until the tenth banknote has been dispensed.

As will be understood, when the counter has been counted down to zero, i.e. upon dispensement of the tenth banknote, no further signal is sent from the counter to the control means and the control means subsequent to said given delay time will not cause the motor 12 to be re-activated, and hence the banknotes will not be raised towards said second terminal position and no further banknote will be dispensed. When the counter 34 has been counted down to zero, it sends to the program circuit a zero signal instructing said program circuit to de-energize the motor 40, thereby stopping the belt 13. If, for some reason, a banknote is dispensed too soon after an immediately preceding banknote, e.g. after 20 ms-constituting the 10 ms activating time of the motor and the 10 ms of a banknote—but before the 30 ms scheduled time sequence has lapsed, re-energization of the motor 12—which should occur about 30 ms after the discharge of a banknote-detection signal—is suppressed by means of a gating circuit incorporated in the program circuit means of the control means 33. In this way, movement of the lifting device 10-11-12 is constantly adjusted to the distance between mutually adjacent dispensed banknotes, i.e. the apparatus in the means is adapted to dispense banknotes in accordance with the aforementioned 50 ms cycle.

It has previously been indicated that subsequent to a completed dispensing operation the lifting device 10, and therewith the whole bundle of banknotes is caused to be lowered from the said second terminal position, this being effected by means of said zero signal sent to said program circuit, said circuit instructing said switching means to change the direction of the current to the motor 12 over a set time period, thereby reversing the direction of rotation of the spindle 11. The control means 33 may also be provided with a program whereby the lifting means, and hence the banknotes resting on the supporting means 24, are lowered when the pressure against the belt 13 is too high. As already mentioned, the force with which the banknotes bear against the belt 13 may increase during a dispensing operation, as a result of a banknote being buckled or creased, for example thereby to raise the banknotes lying thereabove against the belt 13 with a force which is greater than would normally be the case. To this end there is provided adjacent the dispensing opening 26, 27 said pressure-sensing means 36 which is arranged to sense the pressure against the uppermost banknote when ordered by a signal from the program circuit of the control circuit means 43 and which, when the sensed pressure is too high, sends a reversing signal to the control means, which causes the motor 12 to be re-energized through the source 30, but with the reversed polarity, for a period of about 10 ms. Should the pressure still exceed a predetermined value, a further reversing signal is sent to the control means and the motor is energized with said reversed polarity for a further 10 ms. This procedure is repeated until a predetermined pressure is sensed, or until the pressure sensed is beneath said predetermined pressure. The pressure detecting device may be of the kind illustrated and described in U.S. Pat. No. 3,123,355. The said pressure detecting device may also be arranged to constantly monitor the pressure exerted by the bundle of banknotes against the dispensing belt 13 in a manner such as to override any dispensing operation when said pressure exceeds said predetermined value.

If, for some reason or other, no banknote-detecting signal is received by the control circuit arrangement 33, 34 within a given time interval, the arrangement may be such that the motor 12 is re-energized for a period of about 10 ms through a function incorporated in the program circuit of the control means 33, such as to cause the bundle of banknotes to be lifted towards said second terminal position over this period. If still no dispensing signal is registered this sequence is repeated. If, despite this, still no detection signal is registered, say within a period of 2 seconds—perhaps as a result of a banknote in the bundle being buckled and therewith unable to be passed through the dispensing slot—the motor 12 is again re-energized to lift the bundle against the belt 13 (it will be understood that the pressure exerted by said bundle against said belt during these lifting movements will not exceed said limit value for which the pressure-sensing means is programmed.) After this period of 2 seconds plus said 10 ms re-energization period, no further attempt is made to dispense the banknotes automatically, but that the apparatus is caused to show in some way or another that it is temporarily out of order; e.g. by a sign being illuminated to the effect that the withdrawer is referred to the cashier, or by some other means such as a coloured flashing light.

Figure 4:
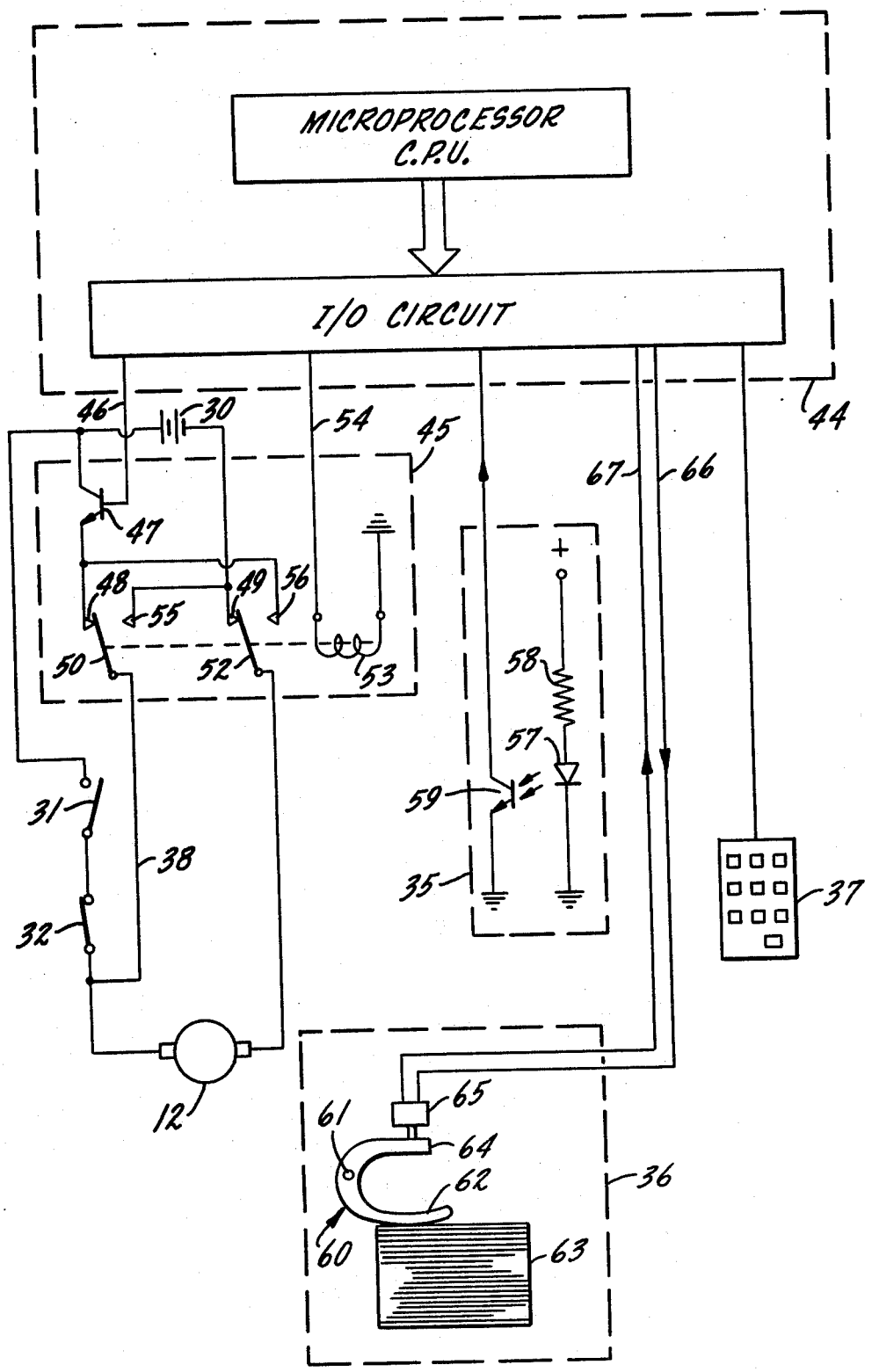
FIG. 4 is a circuit diagram illustrating in more detail the electronic circuit shown in FIG. 3.

From FIG. 4 it will be seen that the control circuit means 43, for the sake of clarity, has been separated into two blocks 44 and 45. The block 44 includes the delay circuit, program circuit and counter shown in FIG. 3, while the switching circuit shown in FIG. 3 is contained in block 45.

The block 44 includes a microprocessor or central processing unit (C.P.U.), such as a central processing unit designated ZILOG Z80 manufactured by ZILOG Incorporated of Cupertino California, U.S.A., which forms a data-AND address-bus. The C.P.U. contains all the functions corresponding to to the counter, the program circuit and the delay circuit of FIG. 3. In turn, the C.P.U. is connected to a parallel input-output, such as a parallel input-output designated ZILOG PIO manufactured by the above U.S. company, arranged to receive signals from external circuits and to transmit output signals dependent upon said incoming signals and upon the pre-programmed C.P.U. The aforementioned signal for activating motor 12 after an ordered number of banknotes has been registered in the counter is sent from the I/O circuit to a conductor 46 to activate a transistor 47. Upon activation of the transistor 47, the circuit from the source 30 is closed through the transistor, a fixed contact relay 48, a movable relay contact 56, the conductor 38, motor 12, a movable relay contact 52, a fixed relay contact 49, and back to the source 30. The two movable relays 50,52 are controlled by a relay 53. When the contacts 50,52 occupy the position shown in FIG. 4, the relay 53 is in action. The motor 12 is driven, as before described, to raise the bundle of banknotes. The relay 53 is connected, via a conductor 54, to I/O circuit, and when the bundle of banknotes is to be lowered, a signal is sent over said conductor 54 to the relay 53, which is thereby activated. When the relay 53 is activated, the movable contacts 50,52 are switched so as to co-operate with fixed relay contacts 55,56 respectively. When a signal on conductor 46 indicates that the motor 12 shall be started, the polarity of the direct current from the source 30 is reversed so as to cause the support 26 and the banknotes thereon to move away from the roller 13.

The detecting means 35 of FIG. 3, as seen more clearly from FIG. 4, comprises an opto-sensor, including a light-emitting diode 57 which is supplied with current through a current-restricting resistance 58. The light emitted by diode 57 is sent to a light-sensitive device 59, such as a light-sensitive transistor, and when broken by a banknote causes a signal to be sent to the I/O circuit instructing the functions described in the aforegoing to be carried out.

In the illustrated embodiment, the pressure sensor 36 comprises an electro-mechanical device, including an angled arm 60 which is pivoted on a shaft 61. The lower part 62 of arm 60 rests against the top surface of the bundle of notes 63, and the upper part 64 of said arm 60 co-operates with a micro-switch 65 which, via conductors 66,67, closes a signal circuit to the I/O circuit to perform the aforedescribed operations.

The keyboard 37 is of the type, arranged to introduce into the counter the number of banknotes ordered, in binary rotation.

What is claimed is:

1. A sheet-dispensing apparatus, comprising:

(a) a sheet-support means arranged for movement between a first terminal position and a second terminal position;

(b) a sheet-picking and dispensing device arranged in the vicinity of said second terminal position;

(c) first drive means coacting with said sheet-supporting means in a manner to move said sheet-supporting means between said terminal positions and also between positions intermediate thereof;

(d) second drive means operative to drive said sheet picking and dispensing device in a manner such as to dispense a given number of sheets from a bundle of sheets carried by said sheet-supporting means;

(e) sheet-ordering means through which a required number of sheets to be dispensed can be ordered;

(f) control circuit means arranged to co-operate with said first and said second drive means in a manner to energize and de-energize the same upon receipt of an appropriate signal;

(g) sheet-detecting means arranged to detect the dispensement of a sheet;

said control circuit means comprising a counter for storing the number of sheets ordered; means for energizing said first and said second drive means upon activation of said sheet-ordering means such that said sheet support means is moved towards said second terminal position for dispensing a sheet; means for de-energizing said first drive means over a given first time period upon receipt of a sheet-detection signal from said detecting means informing that the sheet has been dispensed; means for re-energizing said first drive means for a second given time period when said first time period has lapsed, such as to move said sheet-support means towards said second terminal position; means for adjusting said first given time period when the time lapse between two consecutively dispensed sheets is shorter than a third given time period; and means for re-energizing said first drive means to advance said sheet-support means towards the second terminal position in the absence of a sheet-detection signal in excess of a fourth given period of time.

2. A sheet-dispensing apparatus according to claim 1, comprising means for moving said sheet-support means away from said secnd terminal position when the ordered number of sheets have been dispensed.

3. A sheet-dispensing apparatus according to claim 1, in which the sheets are banknotes and in which the sheet picking and dispensing device comprises a belt against which the uppermost banknote of said bundle of banknotes is brought to bear, said apparatus comprising means for moving said sheet-support means away from said second terminal position when the pressure exerted by said uppermost banknote against said belt exceeds a given limit.

4. A sheet-dispensing apparatus according to claim 1 in which said sheet-support means is arranged in a cassette intended to receive a bundle of sheets, characterized in that when mounting said cassette said lifting means are automatically moved into abutment with said sheet-supporting means and said sheet-supporting means caused to be raised through a given distance, and that means are provided to interrupt movement of said lifting means until said sheet-ordering means is ordered to dispense a given number of sheets.

* * * * *